US010113294B2

(12) United States Patent
Jamilosa

(10) Patent No.: US 10,113,294 B2
(45) Date of Patent: Oct. 30, 2018

(54) MODULAR DESIGN FOR A DIPPER DOOR AND IMPROVED LATCH LEVER BAR

(71) Applicant: Caterpillar Inc., Peoria, IL (US)

(72) Inventor: James Garry Jamilosa, Plainfield, IL (US)

(73) Assignee: Caterpillar Inc., Deerfield, IL (US)

( * ) Notice: Subject to any disclaimer, the term of this patent is extended or adjusted under 35 U.S.C. 154(b) by 240 days.

(21) Appl. No.: 14/941,805

(22) Filed: Nov. 16, 2015

(65) Prior Publication Data

US 2017/0138015 A1 May 18, 2017

(51) Int. Cl.
*E02F 3/40* (2006.01)
*E02F 3/407* (2006.01)
*E02F 3/60* (2006.01)

(52) U.S. Cl.
CPC ..... *E02F 3/4075* (2013.01); *E02F 3/60* (2013.01)

(58) Field of Classification Search
CPC ..... E02F 9/006
See application file for complete search history.

(56) References Cited

U.S. PATENT DOCUMENTS 850,096 A * 4/1907 Pay ..... E02F 3/4075 292/188
1,607,000 A * 11/1926 Hudner ..... E02F 3/4075 37/444
1,653,620 A * 12/1927 Clark ..... E02F 3/4075 37/445
1,905,191 A * 4/1933 Snow, Jr. ..... E02F 3/4075 37/443
1,944,949 A 1/1934 Ratowski
2,025,090 A * 12/1935 Burke ..... E02F 3/40 414/726
2,091,974 A 9/1937 Fykse
2,376,597 A * 5/1945 Jones ..... E02F 3/4075 292/141
5,289,092 A * 2/1994 Schmid ..... H02P 7/295 318/432
5,815,958 A * 10/1998 Olds ..... E02F 3/4075 37/444
6,467,202 B1 10/2002 Brown, Jr.
6,591,521 B2 7/2003 Brown
9,096,992 B2 8/2015 Gilmore et al.
2010/0212194 A1* 8/2010 Hren ..... E02F 3/4075 37/445
2013/0340300 A1* 12/2013 Flores ..... E02F 3/4075 37/445
2015/0089847 A1 4/2015 Gross et al.

FOREIGN PATENT DOCUMENTS

GB 257934 5/1927

* cited by examiner

*Primary Examiner* — Jessica H Lutz
(74) *Attorney, Agent, or Firm* — Law Office of Kurt J. Fugman LLC

(57) ABSTRACT

A latch lever bar for use with a latching mechanism of a dipper door includes a latch bar that includes a yoke. The latch lever bar may include an interface portion that includes a straight surface that is configured to contact the yoke of a latch bar and a pivot connecting portion that is configured to pivotally connect the latch lever bar to the door, wherein the pivot connecting portion defines a pivot point that is substantially collinear with the straight surface of the interface portion.

11 Claims, 8 Drawing Sheets

MODULAR DESIGN FOR A DIPPER DOOR AND IMPROVED LATCH LEVER BAR

TECHNICAL FIELD

The present disclosure relates to the field of machines that move material such as mining machines. Specifically, the present disclosure relates to a dipper door and a dipper bucket on a mining machine and the like, such as a rope shovel.

BACKGROUND

Industrial mining machines, such as electric rope or power shovels, draglines, etc., are used to execute digging operations to remove material from a bank of a mine or a quarry. On a conventional rope shovel, a dipper bucket is attached to a handle, and the dipper bucket is supported by a cable, or rope, that passes over a boom sheave. The rope is secured to a bail that is pivotably coupled to the dipper bucket. The handle is moved along a saddle block to maneuver a position of the dipper bucket. During a hoist phase, the rope is reeled in by a winch in a base of the machine, lifting the dipper bucket upward through the bank and liberating the material to be dug. To release the material disposed within the dipper bucket, a dipper door is pivotally coupled to the dipper bucket. When not latched to the dipper bucket, the dipper door pivots away from a bottom of the dipper, thereby freeing the material out through a bottom of the dipper.

In other words, the dipper door must be held closed while the dipper bucket is being loaded and while the load is being swung to a deposit point. At that time, the dipper is opened to allow the contents of the dipper to empty. Typically, the locking of the dipper door has been accomplished by a mechanical latch that interfaces with a wall of the bucket next to the free edge opposite the rotating attachment of the dipper bucket to the machine. The mechanical latch holds the door in a closed position, and is released by a cable, trip wire, or other device to allow the door to swing open under its own weight and the changing attitude of the dipper bucket as it rotates back in preparation for its next loading cycle.

FIG. 1 illustrates a power or mining shovel 100 as is known in the art. The shovel 100 includes a mobile base 102, drive tracks 104, a turntable 106, a revolving frame 108, a boom 110, a lower end 112 of the boom 110 (also called a boom foot), an upper end 114 of the boom 110 (also called a boom point), tension cables 116, a gantry tension member 118, a gantry compression member 120, a sheave 122 rotatably mounted on the upper end 114 of the boom 110, a dipper bucket 124, a dipper door 126 pivotally coupled to the dipper bucket 124, a hoist rope 128, a winch drum (not shown), a dipper handle 130, a saddle block 132, a shipper shaft 134, and a transmission unit (also called a crowd drive, not shown). The rotational structure 25 allows rotation of the upper frame 30 relative to the lower base 15. The turntable 106 defines a rotational axis 136 of the shovel 100. The rotational axis 136 is perpendicular to a plane 138 defined by the base 102 and generally corresponds to a grade of the ground or support surface.

The mobile base 102 is supported by the drive tracks 104. The mobile base 102 supports the turntable 106 and the revolving frame 108. The turntable 106 is capable of 360-degrees of rotation relative to the mobile base 102. The boom 110 is pivotally connected at the lower end 112 to the revolving frame 108. The boom 110 is held in an upwardly and outwardly extending relation to the revolving frame 108 by the tension cables 116, which are anchored to the gantry tension member 118 and the gantry compression member 120. The gantry compression member 120 is mounted on the revolving frame 108.

The dipper bucket 124 is suspended from the boom 110 by the hoist rope 128. The hoist rope 128 is wrapped over the sheave 122 and attached to the dipper bucket 124 at a bail 140. The hoist rope 128 is anchored to the winch drum (not shown) of the revolving frame 108. The winch drum is driven by at least one electric motor (shown schematically as 141 in FIG. 1) that incorporates a transmission unit (not shown). As the winch drum rotates, the hoist rope 128 is paid out to lower the dipper bucket 124 or pulled in to raise the dipper bucket 124. The dipper handle 130 is also coupled to the dipper bucket 124. The dipper handle 130 is slidably supported in the saddle block 132, and the saddle block 132 is pivotally mounted to the boom 110 at the shipper shaft 134. The dipper handle 130 includes a rack and tooth formation thereon that engages a drive pinion (not shown) mounted in the saddle block 132. The drive pinion is driven by an electric motor and transmission unit (not shown) to extend or retract the dipper handle 130 relative to the saddle block 132.

An electrical power source (not shown) is mounted to the revolving frame 108 to provide power to a hoist electric motor (not shown) for driving the hoist drum, one or more crowd electric motors (not shown) for driving the crowd transmission unit, and one or more swing electric motors (not shown) for turning the turntable 106. In some cases, electric motor 141 powers all of the moving components of the shovel. Each of the crowd, hoist, and swing motors is driven by its own motor controller, or is alternatively driven in response to control signals from a controller 142.

FIGS. 2 and 3 illustrate a dipper door trip assembly that includes a linkage assembly 144 for the shovel 100. The dipper door trip assembly and linkage assembly 144 releases the dipper door 126 from the dipper bucket 124 and allows the dipper door 126 to pivot away from a bottom of the dipper bucket 124. Although the dipper door trip assembly and linkage assembly 144 is described in the context of the power shovel 100, the dipper door trip assembly and linkage assembly 144 can be applied to, performed by, or used in conjunction with a variety of industrial machines (e.g., draglines, shovels, tractors, etc.).

With continued reference to FIGS. 2 and 3, the linkage assembly 144 includes a further pivot structure 146, such as a bolt or rod (not shown clearly) coupled to the lever arm 148. The pivot structure 146 receives an end of the actuation element (e.g., receives a link of a chain of the actuation element 149), allowing the actuation element to pivot relative to the lever arm 148 as the actuation element is moved by the trip motor 143 (see FIG. 1). This structure may be referred to as a tripping mechanism interface where the tripping mechanism is attached to latching mechanism of the door. The pivot structure 146 is sized and shaped to absorb a substantial amount of stress generated by the pulling force of the actuation element on the lever arm 148 as the actuation element is moved by the trip motor.

With reference again to FIG. 3, the linkage assembly 144 further includes a rod 150 pivotally coupled to the lever arm 148. The rod 150 includes a first end 152 that is received at least partially within the lever arm 148 and pivots about a pivot structure 146 coupled to the lever arm 148, such that the rod 150 is able to pivot relative to the lever arm 148. The rod 150 further includes a second end 154 that is coupled to a latch lever bar 156 of the linkage assembly 144. As with the first end 152 though not clearly shown, the second end 154 also includes a spherical bearing or bushing 158 that receives an end 160 of the latch lever bar 156, thereby creating a spherical joint between the rod 150 and the latch lever bar 156 that permits freedom of movement and rotation of the rod 150 about multiple axes relative to the latch lever bar 156. Other constructions include a different type of joint between the rod 150 and the latch lever bar 156 (e.g., a ball joint, etc.).

With reference to FIGS. 1-4, in order to release the dipper door 126 from the latched condition, the trip motor 143 is activated by the controller 142 (see FIG. 1 in particular). When the trip motor 143 is activated, the trip motor 143 pulls an actuation element 149 toward the trip motor 143, thereby causing the lever arm 148 to pivot relative to the pivot structure 146, which causes the rod 150 to move. As the rod 150 is moved, the spherical joints at the first end 152 and the second end 154 of the rod 150 permit relative rotational movement between the rod 150 and both the lever arm 148 and the latch lever bar 156, accounting for any pivoting and arching movement of the lever arm 148 about the pivot structure 146.

As the rod 150 moves generally both rotationally and linearly, the movement of the rod 150 generates a generally rotational movement of the latch lever bar 156, and the movement of the latch lever bar 156 generates a generally linear movement of the latch bar 162. As the latch bar 162 is moved upwardly as shown in FIGS. 2 and 3, the latch bar insert 164 is pulled away from the dipper bucket 124 (see FIG. 4), thereby freeing the dipper door 126 from the dipper bucket 124 by removing the latch bar from a channel found on another part of the bucket such as the bottom wall (see FIG. 4), and allowing the dipper door 126 to swing and pivot open relative to the bottom of the dipper bucket 124 to unload material. As the material is unloaded, for example, into a truck or other vehicle, the components of the dipper door trip assembly and linkage assemblies are positioned to remain well away from the truck and to not interfere with the unloading process.

To return the latch bar insert 164 back into the channel 166 after the material has been unloaded (see FIG. 4), gravity is used (i.e., the latch bar 162 is naturally urged toward the latched position by gravity). In other constructions, a biasing member or members are used to urge the latch bar 162 and the latch bar insert 164 toward the latched position. Because of the high mechanical advantages and forces possible with the dipper door trip assembly and linkage assembly described above, the latch bar insert 164 may be safely extended deep into the channel 166 during this latched condition. This results in a significantly lower likelihood of a false trip and release of the dipper door 126.

Focusing on FIGS. 1 and 4, it can be generally seen that the dipper bucket 124 comprises a shell 168 that includes a bottom wall 170, a top wall 172, and side walls 174 that define an opening 176 and the majority of the enclosed space (bounded on four sides) for holding material. The shell may be made from separate components that are attached to each other or may be made of an integrally cast component, etc.

Turning now to FIG. 5, a dipper door 178 used as part of a dipper bucket on a machine sold under the TRADENAME "7495 Electric Rope Shovel" by the assignee of the present disclosure is shown. The mechanism used to hold the door closed, the general construction of the bucket and operation of the machine are generally similar to that previously described with respect to FIGS. 1 thru 4, except that the exact devices and methods of operation are not the same. That is to say, the door is held closed and is opened on the bucket and the machine uses a mechanical system to effectuate this locking and unlocking in a manner similar to what has been described although not exactly the same.

Likewise, the manner in which the shovel works in moving material from one location to another using the bucket, door and latching mechanism is similar to what has been already described. It is to be understood that any variation of a locking mechanism known or that will be devised in the art may be used with any of the embodiments discussed herein and any machine that moves material may use any of the embodiments discussed herein. Consequently, the description given with reference to FIGS. 1 thru 4 is by way of example only and is intended only to provide a general understanding to the reader on how various embodiments of the present disclosure are used and constructed.

Looking at the construction of this dipper door 178 in FIG. 5, it can be seen that includes a substantially flat base 180 that defines the height H (measured along the Y axis of the Cartesian coordinates as shown) and width W (measured along the X axis of the Cartesian coordinates as shown) of the door. The exterior surface 182 of the flat base can be seen, so called as it faces away from the interior of the bucket where material is stored during excavation. Hinge points 184 are located near the upper end 186 of the flat base 180 defined by flanges 187 that extend upwardly along the Y direction and then in a direction that is toward the interior of the bucket (−Z direction) when the door is installed on the bucket. A reinforcing pad 188 is located near the free or lower end 190 of the base that is opposite the upper end 186. Reinforcing gussets 192 extend from the side of the reinforcement pad 188 toward the free end 190 of the base 180. A latching guide 194 is housed inside of the reinforcing pad 188 that provides a place for a latch bar to move up and down to lock and unlock the door as previously described. This latching guide includes a channel 196 that opens along the lower free end 190 of the base plate 180 through which a latching member can extend to lock the door.

Three reinforcing ribs 198 extend from the reinforcing pad 188 in an upward Y direction and terminate near the top edge 186 of the flat base 180 into a horizontal stiffening rib 200 that extends along the top edge 186 of the flat base 180 along the X direction. Looking at FIG. 5, the side of the right most rib 198*a* includes a through slot 202 for accommodating the latch level bar for the latching mechanism as previously described. Similarly, the center vertical reinforcing rib 198*b* includes a slot 204 through its upper surface and a through slot 206 through the entire rib in the general −X direction to contain or allow movement of various parts of the latching mechanism. The leftmost vertical reinforcing rib 198*c* has no slots in it as the latching mechanism does not need to engage this structural member.

Accordingly, all three vertical reinforcing ribs 198 have different construction that necessitate different parts that are welded to each other and the base plate 180. In fact, the door 178 is essentially a series of sheet metal components that are welded onto the flat base. It should be noted that the middle portion of the horizontal rib 200 and the center vertical rib 198*b* are recessed as compared to the top surfaces of the flanges 187 and other two vertical ribs.

As can be imagined, the bucket that uses the door of FIG. 5 needs to be adjusted in size so that different fill capacities may be provided for various applications in the field. For example, dipper bucket sizes may vary from 46 cubic yards to 89 cubic yards for the 7495 Electric Rope Shovel. Furthermore, the shape of the buckets may vary such as having straight sides or have a trapezoidal shape, which is referred to as a FastFil configuration in the art. To account for these different sizes and shapes, the height, shape, or other dimensions or characteristics of the door must be changed. Specifically, the door height is often varied which requires dimensional changes to 10 different parts or components.

Looking at FIG. 5, the components that need to be changed dimensionally along the Y axis include the base 180, top panel 208 of right rib 198*a*, right side panel 210 of right rib 198*a*, left side panel 212 of right rib 198*a*, top panel 214 of center rib 198*b*, right side panel 216 of center rib 198*b*, left side panel 218 of center rib 198*b*, 220 top panel 220 of left rib 198*c*, right side panel 222 of left rib 198*c*, and left side panel 224 of left rib 198*c*. This requires more parts to be stocked in inventory and also more time to manufacture doors of various sizes. This leads to an undesirable increased cost and lead time for each sized door.

Now focusing on FIG. 6, a known latch mechanism 226 construction is shown that is used with the door 178 of FIG. 5. The right rib 198*a* can be seen and the latch lever bar 228 extends through this slot 202. At the right end of the latch lever bar 228, part of the latch tripping mechanism or tripping mechanism interface 230 may be seen. At the left end of the latch lever bar 228, a pivot connecting portion 232 of the latch lever bar can be seen that is pivotally mounted to structure found in the middle vertical stiffening rib 198*b*. The latch lever bar 228 passes through the slot of the yoke 234 of the latch bar 236. When the latch tripping mechanism 230 is activated, the right of the of the latch lever bar 228 moves upward causing the latch lever bar to rotate upwards about the pivot point 238 defined by the pivot connecting portion until it contacts the upper end of the yoke 234 of the latch bar 236, pulling the bar upwards until the door is unlocked. Deactivation of the tripping mechanism causes this process to reverse itself until the door is locked once more. Two mounting plates 240 are attached via welding proximate the upper end of the slot 202 and lower end of the slot 202 found in the right vertical reinforcing rib 198*a*. Bumper stops 242 are attached to the mounting plates 240 that limit the travel of the latch lever bar 228 upwardly and downwardly. A protrusion 244 is found on the lower edge of the latch lever bar 236 that is configured to contact the lower bumper before the latch lever bar bottoms out in the slot 202. The top edge of the latch lever bar lacks such a protrusion but includes a recess 246 on the yoke interface portion 248 of the latch lever bar 228 where contact is made between the latch lever bar 228 and the latch bar 236. It has been found that this latching mechanism experiences wear problems in the field, necessitating replacement.

Accordingly, it is desirable to reduce the cost of door manufacture by reducing the number of parts that are changed to make doors of various sizes and to decrease the time to manufacture each door. In turn, this should reduce the lead time to supply various sized doors to a customer. Furthermore, it is desirable to improve on the current latching mechanism to reduce field replacement.

SUMMARY

A latch lever bar for use with a latching mechanism of a dipper door is provided that includes a latch bar that includes a yoke. The latch lever bar may include an interface portion that includes a straight surface that is configured to contact the yoke of a latch bar and a pivot connecting portion that is configured to pivotally connect the latch lever bar to the door, wherein the pivot connecting portion defines a pivot point that is substantially collinear with the straight surface of the interface portion.

A dipper door is also provided that comprises a latching mechanism and a tripping mechanism interface that is configured to initiate movement of the latching mechanism, wherein the latching mechanism includes a latch bar that includes a yoke and a latch lever bar. The latch lever bar may comprise an interface portion that includes a straight surface that is configured to contact the yoke of a latch bar; and a pivot connecting portion that is configured to pivotally connect the latch lever bar to the door, wherein the pivot connecting portion defines a pivot point that is substantially collinear with the straight surface of the interface portion of the latch lever bar.

A method of manufacturing a dipper door may also be provided that includes a first base member, a first stiffening element, a second base member, a second stiffening element and a connecting member. The method may comprise abutting the first base member and the second base member forming a seam and attaching the connecting member to the first stiffening element and to the second stiffening element in a manner that straddles over the seam.

BRIEF DESCRIPTION OF THE DRAWINGS

The accompanying drawings, which are incorporated in and constitute a part of this specification, illustrate several embodiments of the disclosure and together with the description, serve to explain the principles of the disclosure. In the drawings.

Figure 1:
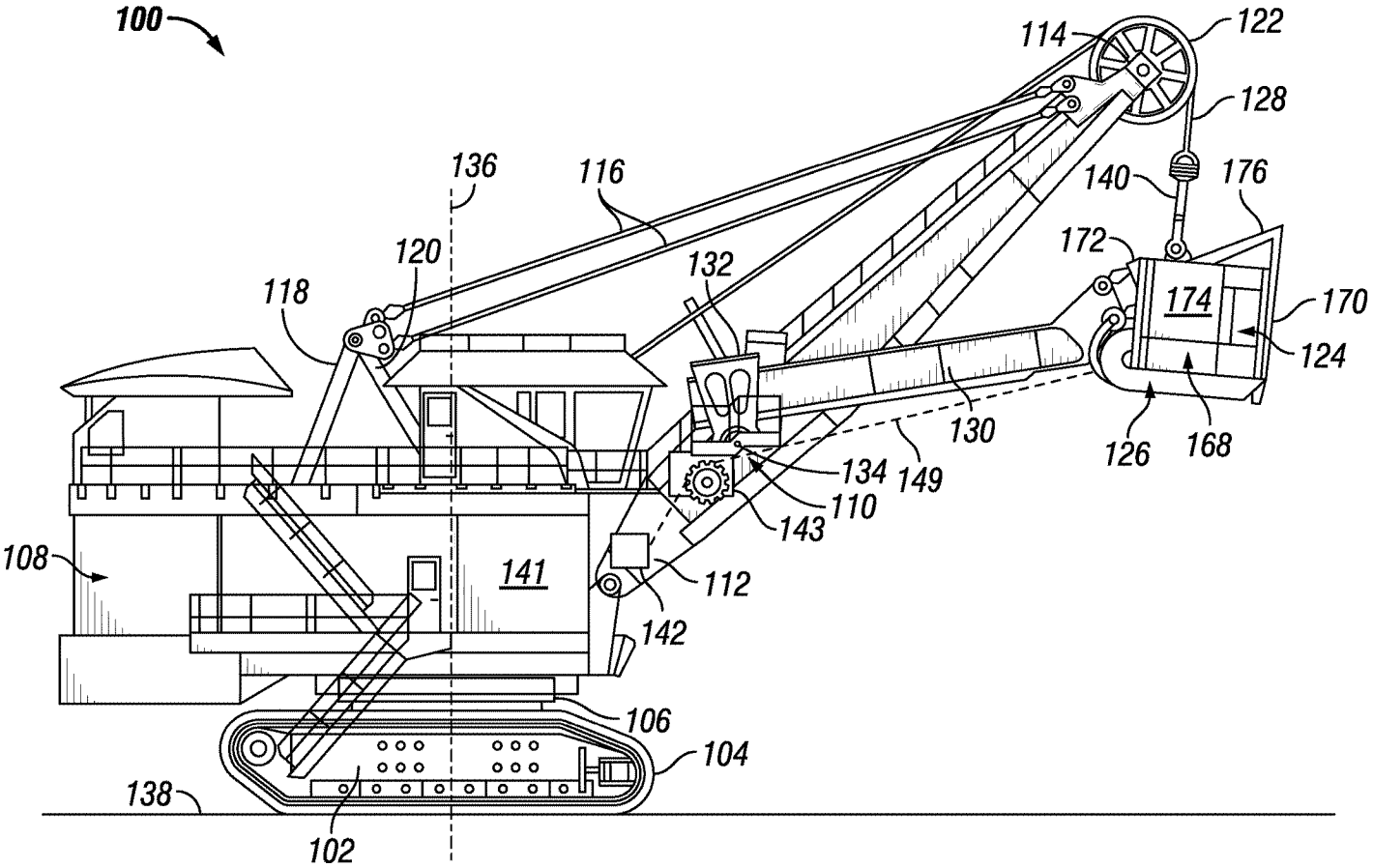
FIG. 1 (Prior Art)
FIG. 1 is a perspective view of a mining shovel as is known in the art.

The horizontal and vertical directions correspond to the X and Y axes of the Cartesian coordinates that are provided in the drawings.

DETAILED DESCRIPTION

Reference will now be made in detail to embodiments of the disclosure, examples of which are illustrated in the accompanying drawings. Wherever possible, the same reference numbers will be used throughout the drawings to refer to the same or like parts. In some cases, a reference number will be indicated in this specification and the drawings will show the reference number followed by a letter for example, 100*a*, 100*b* etc. It is to be understood that the use of letters immediately after a reference number indicates that these features are similarly shaped and have similar function as is often the case when geometry is mirrored about a plane of symmetry. For ease of explanation in this specification, letters will often not be included herein but may be shown in the drawings to indicate duplications of features discussed within this written specification.

Figure 7:
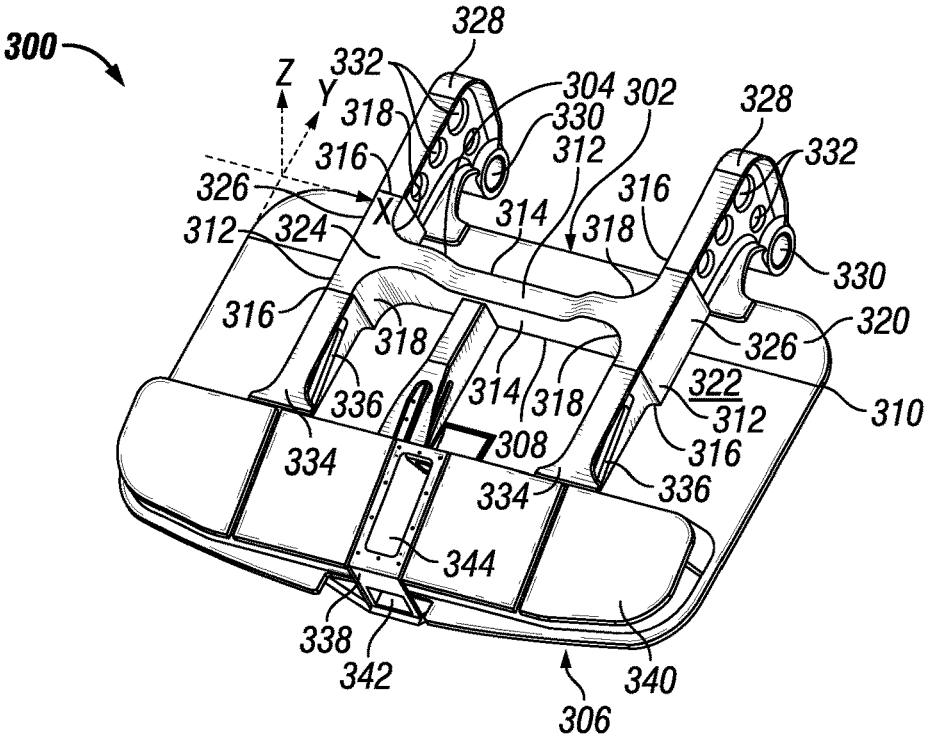
FIG. 7 is a perspective view of the dipper door according to an embodiment of the present disclosure.
Figure 9:
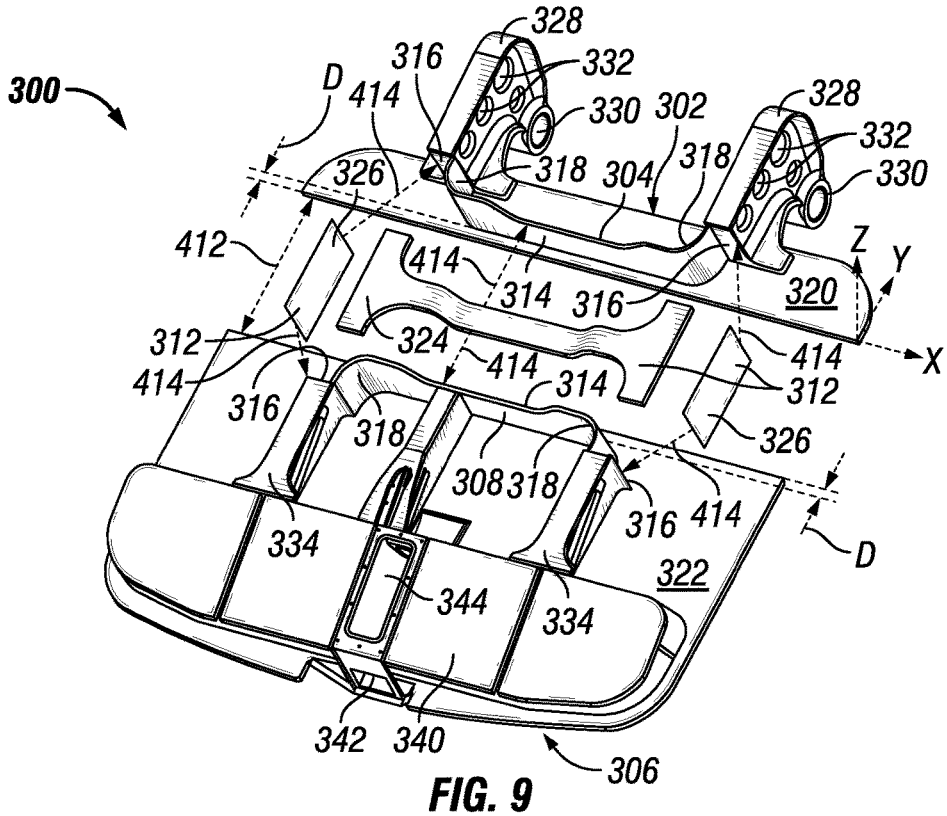
FIG. 9 is partially exploded perspective assembly view of a dipper door of FIG. 7 showing the upper and lower module assemblies already assembled.

Looking now at FIGS. 7 and 9, an embodiment of a dipper door 300 is shown according to one embodiment of the present disclosure. It is to be understood that this door may be used with any bucket shell or machine described earlier herein. The dipper door 300 comprises a first module assembly 302 including a first projection 304 and a second module assembly 306 including a second projection 308, wherein the first and second module assemblies abut, forming a seam 310 that is a predetermined distance D away from either the first or second projection 304, 308. In the embodiment shown, the first and second projections are both spaced away from the seam but it is contemplated that one of the projections may be directly on the seam. Furthermore, the distance any projection is from the seam may be adjusted as desired. Also, the seam 310 is oriented in the horizontal X direction but may form any angle or Cartesian plane, including but not limited to a Y-Z plane. Since the seam is horizontal or in a X-Z plane, the first module assembly 302 may be referred to as an upper module assembly and the second module assembly 306 may be referred to as a lower module assembly because they are spaced apart in the Y or vertical direction.

In some embodiments, only one base plate such as the lower base plate may be trimmed by a distance D or some incremental value thereof in order to make buckets of different sizes as will be discussed later herein. This allows both upper and lower modules to be stocked and only the lower module to be trimmed to create a door of the desired size.

The door 300 further comprises a connecting member 312 that contacts the first projection 304 and the second projection 308. The first projection 304 may take the form of a first stiffening element and the second projection 308 may take the form of a second stiffening element. As shown, the first and second stiffening elements 304, 308 have the identical configuration with a central member 314 that runs in the horizontal X direction and two side members 316 that are coplanar and that run in parallel to the central member 314. They are connected to and spaced away from the central member 314 by transition portions 318 that take the form of blends but other transitional geometry such as chamfers could be used. The stiffening elements are formed by a plate of metal or steel that is bent or otherwise formed into shape using methods and devices known in the art. Alternatively, these elements could be machined, fabricated or cast. Also, the configurations of these stiffening elements may be varied as desired and may be different from each other.

It is contemplated that the first and second projection could be any type of mounting structure to which a connecting member may be attached. Hence, the first and second projections may not significantly add to the structural rigidity of the door in some embodiments.

FIGS. 7 and 9 also depict that the first module assembly 302 comprises a first base plate 320 and the first projection 304 comprises a first stiffening element that is parallel to the seam 310 and that is connected to the first base plate. Similarly, the second module assembly 306 comprises a second base plate 322 and the second projection 308 comprises a second stiffening element that is parallel to the seam 310 and that is connected to the second base plate 322. The connecting member 312 spans across the seam 310 to contact the stiffening elements.

As shown in this embodiment, the connecting member 312 may take different forms. For example, the top plate 324 of the horizontal rib may be considered a first connecting member that spans from the first stiffening element to the second stiffening element and may be attached to both these stiffening elements. Alternatively, the side panels 326 that are attached to the first and second base plates 320, 322 and that also connect to the side members 316 of the first and second projections 304, 308 may be considered a connecting member. In some embodiments, the top panel and side panels may be forms by a metal forming process similar to that used to make the first and second stiffening elements. In such a case, the connecting members would constitute a single piece of material. For the specific embodiment shown in FIG. 7, the top panel 324 has a substantially "capital I" configuration when viewed in the Z direction.

The dipper door of FIGS. 7 and 9 may also be described in the following manner. It may comprise a first module assembly 304 that includes a first base member and a second module assembly that includes a second base member. In some cases, a base member may have dimensions where its height and width in the Y and X directions are substantially greater than its thickness in the Z direction. In such a case, the base member may be referred to as a base plate 320, 322. It is contemplated that the configuration of a base member may be varied as desired. Also, the first base member and the second base member contact each other forming a seam 310 and the connecting member, in any form including a top panel or a side panel, spans across and over the seam 310. In the case of connecting members that include the side panels, the connecting member 312 may be said to contact the first base plate 320 and the second base plate 322 or be immediately adjacent thereto. As mentioned earlier, the first stiffening element is attached to the first base plate of the first module assembly and the second stiffening element is attached to the second base plate of the second module assembly such that the first and second stiffening elements are positioned a predetermined distance away from the seam. These stiffening elements may run parallel to the seam or they may run at an angle to the seam.

The connecting member 312 may run substantially vertically. That is to say, its dimensions in the Y direction may exceed its dimensions in the X or Z directions. An example of this are the side panels 326. Similarly, the connecting member may run substantially in the horizontal direction as is the case when its dimensions in the X direction exceed its dimensions in the Y or Z directions. The connecting member 312 may include a flat base and two flanges that extend perpendicular from the flat base. This may be true when the side panels 312 are made integral with the flat base or top panel 324 using a sheet metal bending or forming operation.

In various other embodiments of the present disclosure, the dipper door 300 may include a module assembly that includes sheet metal components and at least one cast component that are attached or otherwise assembled to each other. Again looking at FIGS. 7 and 9, either module assembly has sheet metal components such as the connecting members 312 and cast components that are attached to a base plate 320, 322. For the upper module assembly 302, there are two identical cast parts that form the flanges 328 that define the hinge points 330 of the door. Cavities or through holes 332 are formed in the web of these flanges 322 for avoiding casting defects such as porosity and sinks Making these flanges using the casting process reduces the number of components and seams that need to be welded, reducing manufacturing time and cost. Using identical parts reduces the number of parts needed to make doors.

Figure 2:
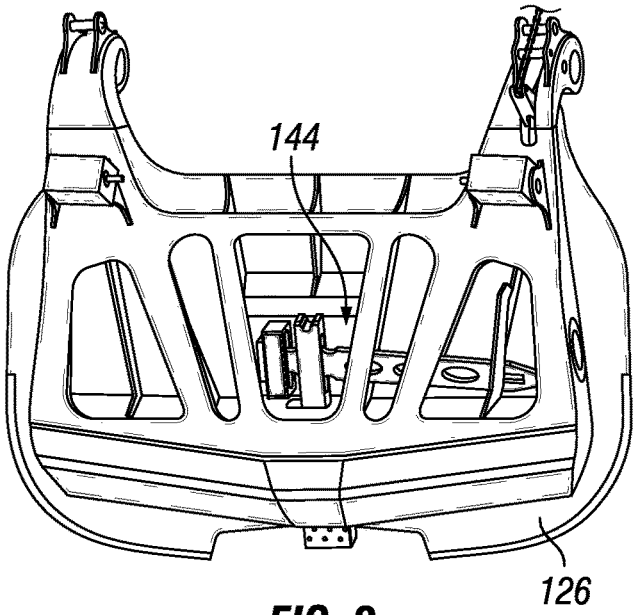
FIG. 2 (Prior Art)
FIG. 2 is a perspective view of the dipper door and linkage assembly of the dipper door trip assembly that is partially disposed within the dipper door shown in isolation from the dipper bucket of the mining shovel of FIG. 1 is an enlarged side view of the engine of FIG. 1 showing the joints more clearly and associated seals and seal retaining structure in hidden lines.
Figure 3:
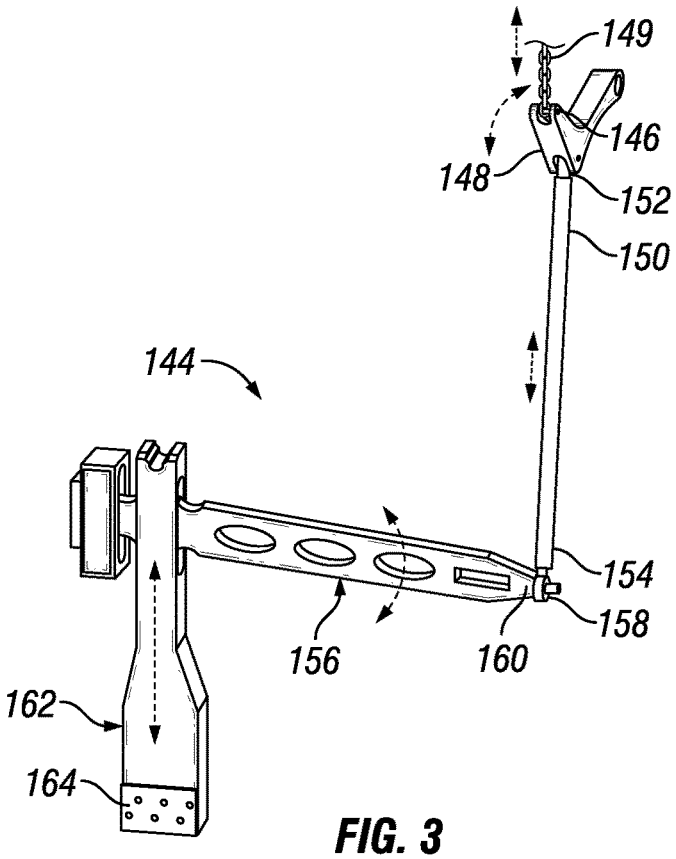
FIG. 3 (Prior Art)
FIG. 3 is a perspective view of the linkage assembly of FIG. 2 shown in isolation from the dipper door.
Figure 4:
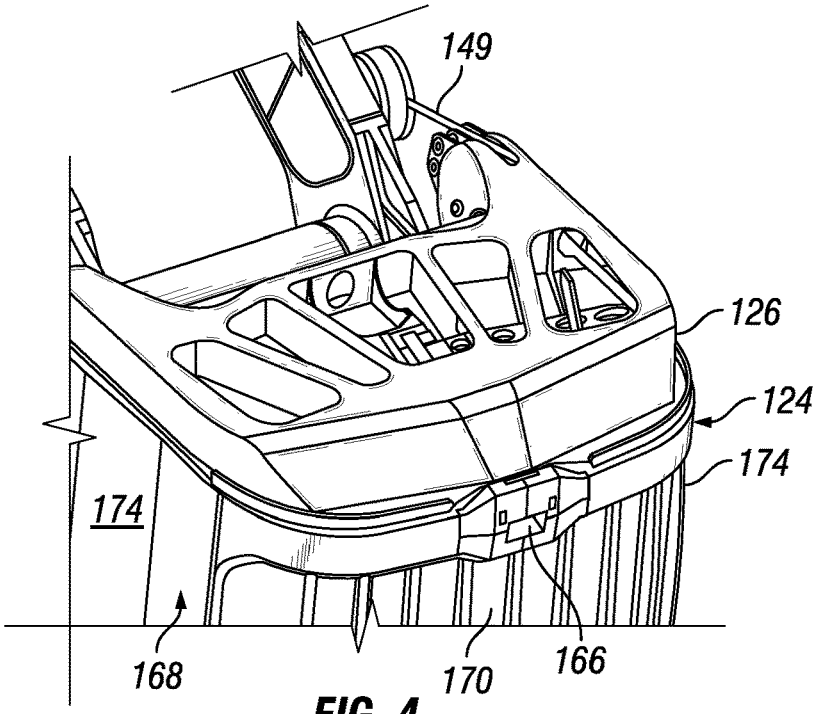
FIG. 4 (Prior Art)
FIG. 4 is a perspective view of the dipper bucket of the mining shovel of FIG. 1 shown in isolation from the mining shovel, illustrating a channel on the dipper that receives a portion of the linkage assembly of FIGS. 2 and 3 to latch the dipper door in closed position.

Similarly, the lower module assembly 306 includes two identical cast parts in the form of partial side ribs 334 that define slots 336 to accommodate or receive any part of the latch mechanism. For example, any component shown in FIG. 3 may be considered a latch mechanism component or member. The latch box 338 is also cast and is attached to the base plate 322 and the reinforcement pad 340. The latch box 338 defines a channel 342 for receiving the latch bar (see FIG. 8). The latch box may also define a window 344 that is configured to allow access to the latch bar wear plate (see 164 in FIG. 2). A cover (not shown) for this window may be provided that can be attached to the latch box using fasteners or the like. The number and configuration of cast parts may be varied as desired depending upon the application or may be substituted with all fabricated parts if desired although this increases the amount of welding that is necessary to make the door.

Figure 6:
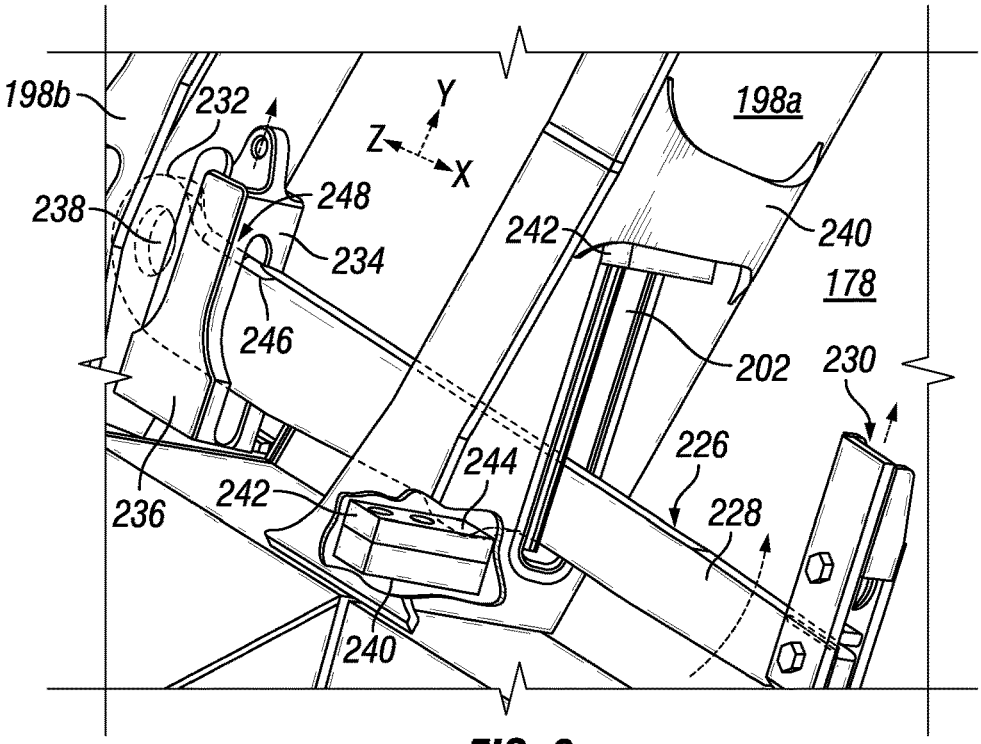
FIG. 6 (Prior Art)
FIG. 6 is a perspective view of the latching mechanism used on the door of FIG. 5.
Figure 8:
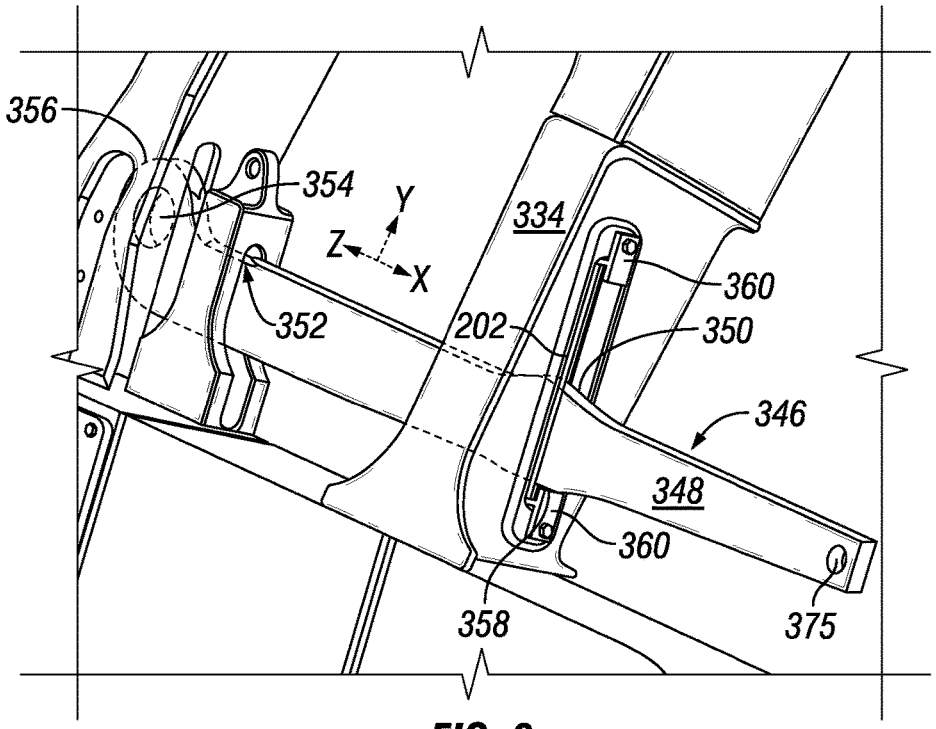
FIG. 8 is a perspective view of the latching mechanism used on the door of FIG. 7.

Turning now to FIG. 8, a latching mechanism 346 according to another embodiment of the present disclosure is given. The following changes have been made to the latching mechanism of FIG. 6 and are illustrated in FIG. 8. The latching mechanism 346 includes a revised latch lever bar 348 on its top edge but now has a protrusion 350. In other embodiments, it may be otherwise uninterrupted by any other geometrical feature including a recess or a radius. Also, the yoke interface portion 352 is now substantially straight and level horizontally with the pivot point 354 that is defined by the pivot connecting portion 356 of the latch lever bar 348 (see also FIGS. 12 and 13). Furthermore, the protrusion 358 found on the lower edge of the latch lever bar 348 is greatly reduced for reasons set forth later with respect to FIGS. 12 and 13. The bumper stops 360 are now connected directly to the partial right rib 334 and are positioned within its slot 202. This reduces the number of components needed to make the door. At the right end can be seen an aperture 375 that is used to connect the latch lever bar to the tripping mechanism.

INDUSTRIAL APPLICABILITY

Figure 10:
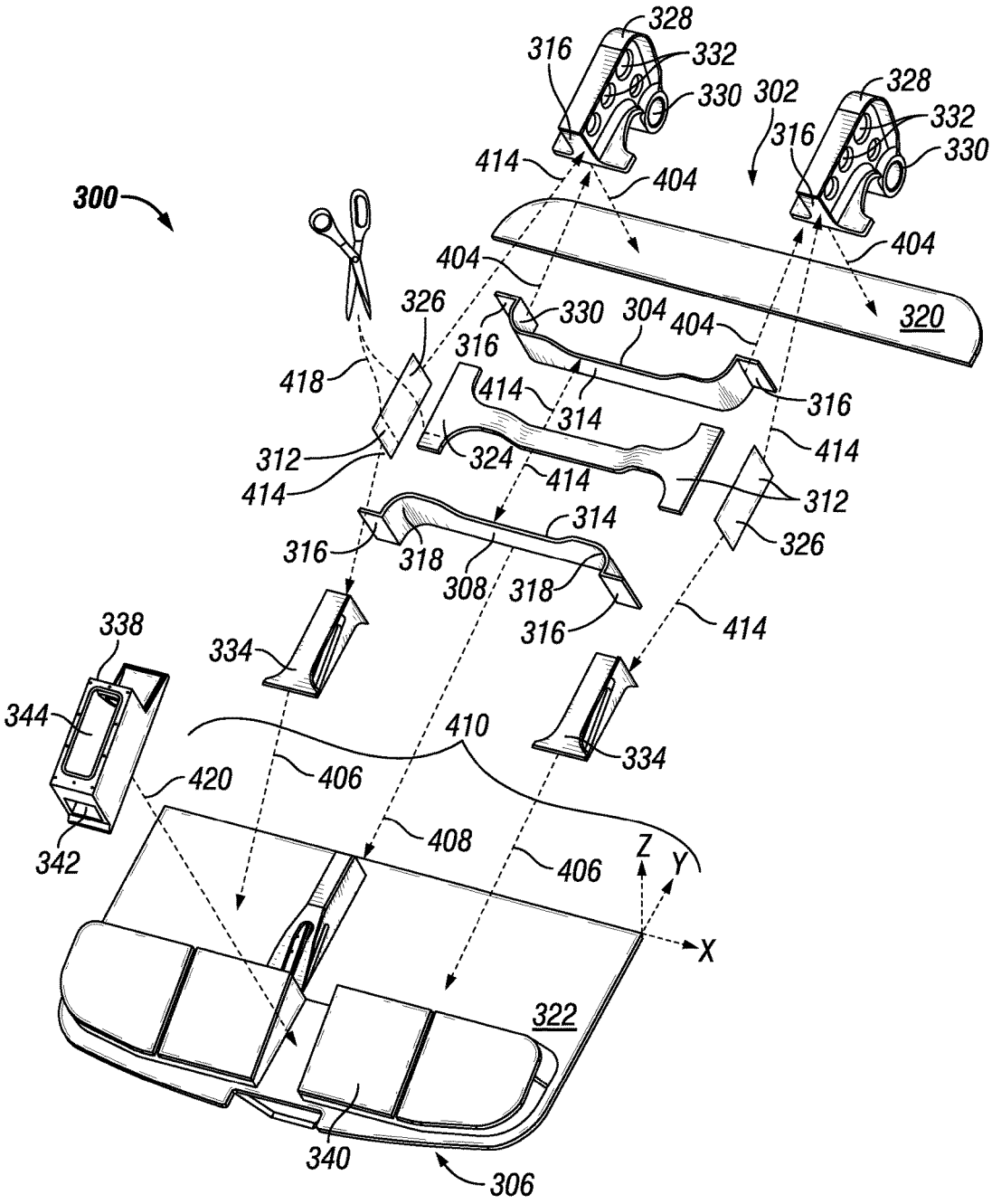
FIG. 10 is a more fully exploded perspective assembly view of the dipper door of FIG. 7.
Figure 11:
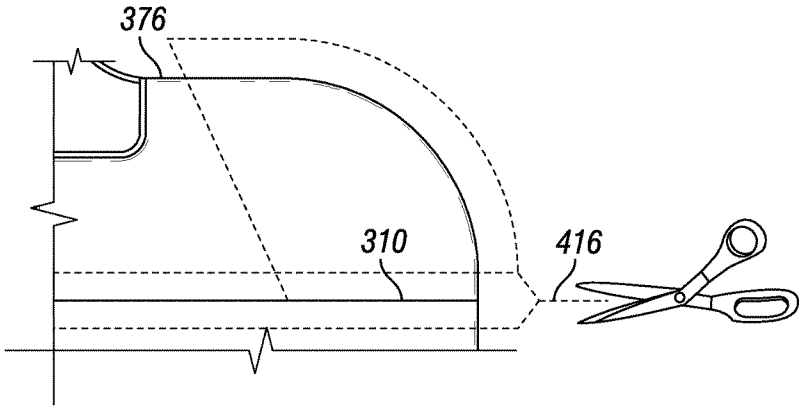
FIG. 11 is a top enlarged detail view of a portion of the dipper door of FIG. 6 showing the upper right corner of the door in more detail.

Finally focusing on FIGS. 9 thru 11, the method of manufacturing and assembly for the door of FIG. 7 can be explained. First, a first base member 320 and a first stiffening element 304 may be provided. This could entail machining, fabricating or casting the base member with suitable dimensions and forming the first stiffening element using a sheet metal bending or forming process as already described. Alternatively, the first stiffening element may be machined, fabricated or cast. Furthermore, the flanges 328 that define the hinge points 330 may also be provided using a casting process although they may be formed by machining or as a sheet metal subassembly. They may be attached to the first base member represented by step 400 of FIG. 10. Similarly, the stiffening element may be attached to the base plate (see step 402 of FIG. 10). Steps 400 and 402 may together contribute to step 404 where the first module assembly is formed.

In like manner, the second base member 322 and a second stiffening element 308 may be provided as has just been described with respect to the first base member and the first stiffening element. Similarly, the slotted castings 334 for holding the various components of the latching mechanism may also be attached to the second base member 322 represented by step 406 of FIG. 10. Step 408 represents attaching the second stiffening element to the base plate. Steps 406 and 408 may together contribute to step 410 where the second module assembly is formed. The first and second base members may be abutted forming a seam as represented by step 412 of FIG. 9. This may be done before or after any module assembly has been created. Then, a connecting member 312 such as top panel or side panel may be attached to the first stiffening element and second stiffening element as represented by step 414 of FIG. 9. In either case, the connecting element may straddle over the seam or may even touch the seam or be immediately adjacent the seam as is the case for the side panels.

It should be noted that any "providing" steps referred to herein include situations where one or more components are manufactured, sold, bought, etc. Also, the term "module assembly" as used herein refers to any construction where there is a seam and one or more parts are attached to a base member regardless of the timing of when certain components are attached to each other. Hence, a module assembly may be assembled before it contacts another module assembly to form a seam or base members may form a seam and then components may be attached to the base members, etc.

As shown most clearly in FIG. 11, various trimming may be accomplished to the first base member or second base member to change the dimensions of the door to accommodate buckets of different fill capacities. The untrimmed seam 310 is for a 72 cubic yard bucket. The highest trim line is for a 62 cubic yard bucket. If both the highest and lowest trim lines are used, then a door compatible with a 59 cubic yard bucket is created. Also, angled trim lines that start at the upper edge 376 of the door toward the seam create a FastFill configuration. The trimming is represented by step 416 of FIG. 11. Any connecting member may also be trimmed and is represented by step 418 of FIG. 10. In some embodiments, the horizontal trim lines are found only on the lower base and the upper base remains untrimmed regardless of the size of bucket that is needed but the upper base may be trimmed to achieve a trapezoidal or FastFill configuration.

Figure 5:
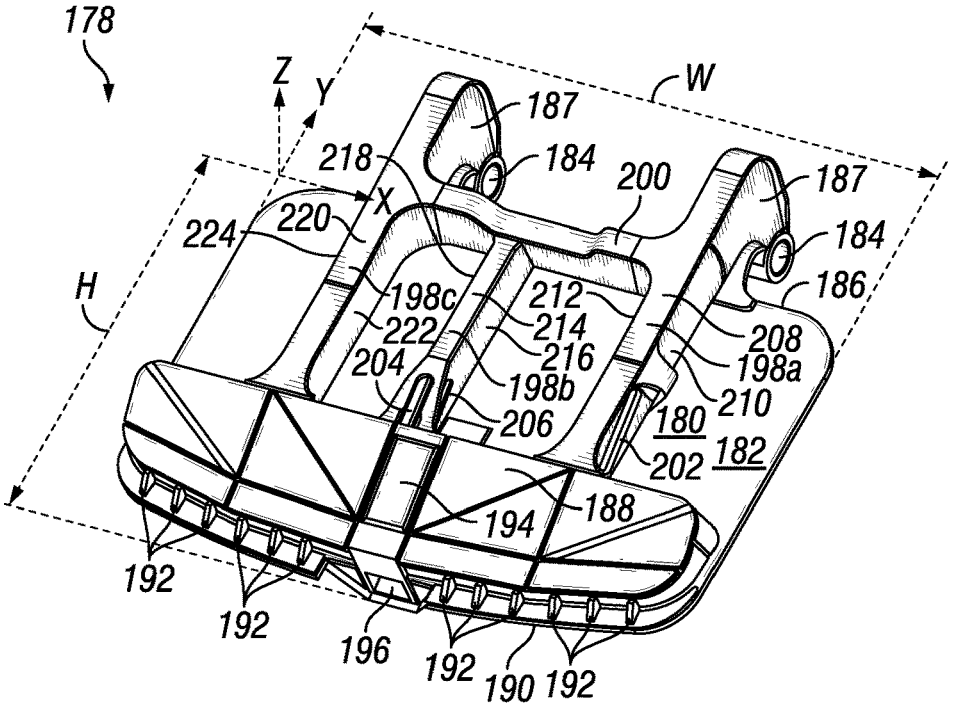
FIG. 5 (Prior Art)
FIG. 5 is a perspective view of another dipper door that is similar to that shown in FIGS. 1 thru 4 that is also known in the art.

Any of the attaching or abutting steps described herein may comprise or be followed up with a welding operation. The number of welds needed to make the door using embodiments of the present disclosure are reduced as compared to what has been previously needed to make the door of FIG. 5 due to the reduction in the number of components and seams between them.

Figure 12:
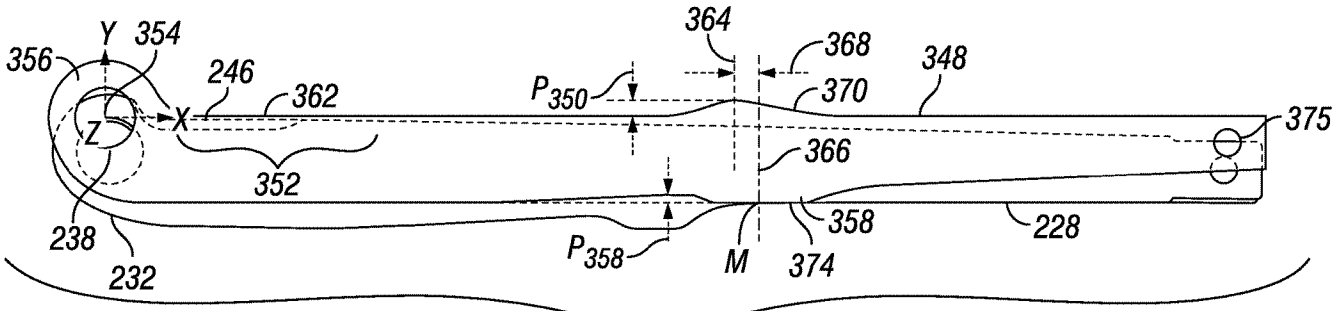
FIG. 12 is a front view of the latch lever bar of FIG. 8 superimposed on the latch lever bar of FIG. 6 in their locked configurations.

Looking at FIG. 12, the revised latch lever bar 348 is superimposed on the latch lever bar 228 of the previous design. As can be seen, its pivot point 354 is higher than previously and is now aligned or collinear with the straight or level edge or surface 362 of the yoke interface portion 352. It is contemplated that the straight surface or level edge may be found on a surface that is or is not in a recess or pocket in some embodiments.

It may be preferable in some embodiments to assemble the upper and lower module assemblies individually before the lower module is trimmed to the correct size. Then after trimming, both modules may be abutted and the rest of the connecting members attached.

Also, the new latch lever bar 348 has a bottom protrusion 358 that extends far enough in the negative Y direction to be flush with the bottom surface of the latch lever bar adjacent the yoke interface portion of the latch lever bar. A recess or radius is located between the bottom protrusion and the bottom surface of the latch bar, creating a distance P358 from the bottom protrusion to the apex of this recess. This may be 9.4 mm as measured in the Y direction Furthermore, a new top protrusion 350 has been added that extends from the body (which defines Cartesian X, Y, Z coordinates) of the new latch lever bar a greater distance P350 (may be approximately 4 cm) in the Y direction than the distance P358. Also, the centerline 364 of the top protrusion 350, which runs in the Y direction and passes through the apex of the top protrusion, which where the sloping surfaces meet, is offset from the centerline 366 of the bottom protrusion 358, which runs in the Y direction and passes through the midpoint M of the plateau 374, a distance 368 in the negative X direction. The right sloping surface 370 is configured to hit a stop member, acting as a stop surface, as it becomes horizontal as the latch lever bar 348 rotates (see FIG. 14). The width W of the plateau may be approximately 27.8 cm.

On the other hand, the left sloping surface 372 is merely a transition from the top edge to the right sloping surface 370 of the top protrusion 350. The plateau 374 of the bottom protrusion 358 acts as a stop surface similar to that of the previous design. Finally, a second end that is opposite of the first end that has the pivot connecting portion 356 also has the same aperture 375 that is used to connect the latch lever bar to the tripping mechanism. The distance from the center of this pivot point to the center of the aperture may be approximately 259 cm.

Figure 13:
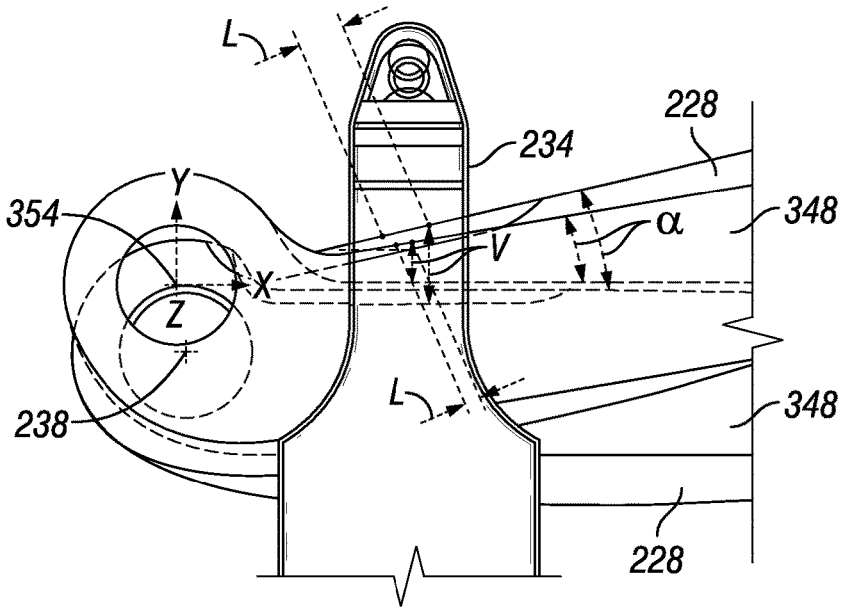
FIG. 13 is an enlarged perspective view of the pivot connection and yoke interface portion of the latch lever bars of FIG. 12, showing their respective vertical sliding movement and lateral sliding movement relative to the latch lever bar when moving from the locked to their unlocked configurations and also the necessary angular movement needed to achieve these configurations.

FIG. 13 shows that the improved design requires less pivot angle $\alpha$ (10 degrees versus 13 degrees), less lateral sliding movement L relative to the latch bar in the X direction (4 mm versus 27 mm), and less vertical latch bar movement V (48 mm versus 69 mm) This is due to the removal of the recess in the yoke interface portion and the alignment of the pivot point with a level or straight surface. This results in less wear and need for replacement in the field.

Figure 14:
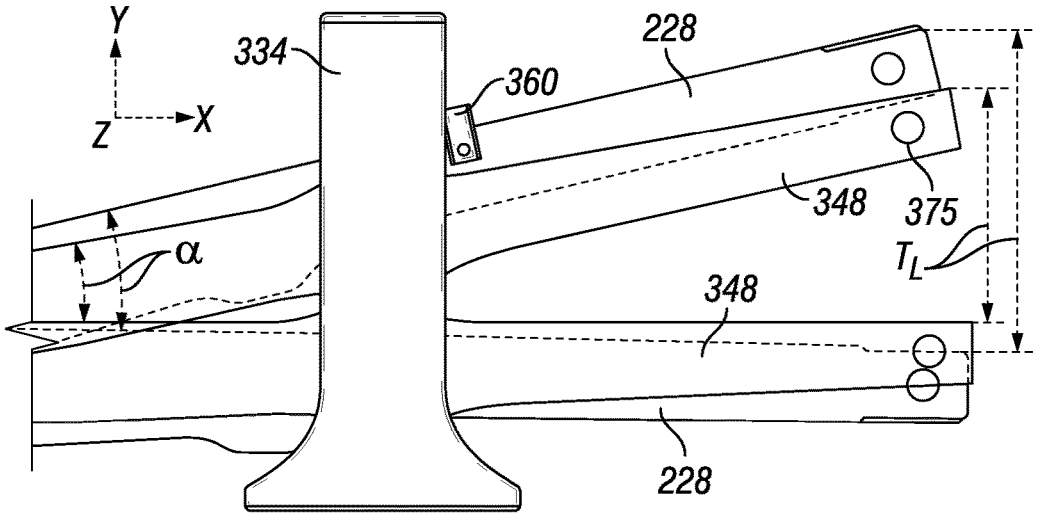
FIG. 14 shows the vertical trip lengths necessary to move from the locked to the unlocked configuration for the latch lever bars of FIG. 13.

Finally, FIG. 14 illustrates that the new design requires less vertical trip length TL to move the latch lever bar from the locked to the unlocked configuration as compared to the previous design (469 mm versus 646 mm) This improved efficiency also results in less wear on the latching and tripping mechanisms, prolonging life.

It will be apparent to those skilled in the art that various modifications and variations can be made to the embodiments of the apparatus and methods of assembly as discussed herein without departing from the scope or spirit of the invention(s). Other embodiments of this disclosure will be apparent to those skilled in the art from consideration of the specification and practice of the various embodiments disclosed herein. For example, some of the equipment may be constructed and function differently than what has been described herein and certain steps of any method may be omitted, performed in an order that is different than what has been specifically mentioned or in some cases performed simultaneously or in sub-steps. Furthermore, variations or modifications to certain aspects or features of various embodiments may be made to create further embodiments and features and aspects of various embodiments may be added to or substituted for other features or aspects of other embodiments in order to provide still further embodiments.

Accordingly, it is intended that the specification and examples be considered as exemplary only, with a true scope and spirit of the invention(s) being indicated by the following claims and their equivalents.

What is claimed is:

1. A latch lever bar for use with a latching mechanism of a dipper door that includes a latch bar that includes a yoke, the latch lever bar comprising:

an interface portion that includes a straight surface that is configured to contact the yoke of a latch bar; and a pivot connecting portion that is configured to pivotally connect the latch lever bar to the door, wherein the pivot connecting portion defines a pivot point that is collinear with the straight surface of the interface portion;

the latch lever bar comprises a body that defines an X and a Y direction, and a X-Z plane; wherein the latch lever bar comprises a top protrusion that extends from the body a distance measured in the Y direction;

the body of the latch lever bar defines a bottommost edge adjacent the yoke interface portion along the X direction and a recess with an apex that extends from the bottommost edge along the X direction, the body further comprising a bottom protrusion that extends from the body a distance measured in the negative Y direction such that the bottom surface of the bottom protrusion is flush with the bottommost edge in a plane parallel to the X-Z plane containing the bottommost edge, defining a distance between the apex of the recess and the bottommost edge measured in the Y direction;

the distance between the apex of the recess and the bottommost edge is less than the distance that the top protrusion extends from the body of the latch lever bar;

the bottom protrusion includes a plateau and the top protrusion includes a right sloping surface that is configured to be a stop surface.

2. The latch lever bar of claim 1 wherein the interface portion is uninterrupted by any other geometrical feature other than the straight surface.

3. The latch lever bar of claim 1 wherein the top protrusion includes a left sloping surface.

4. The latch lever bar of claim 3 wherein the top protrusion defines a centerline that runs in a direction parallel with the Y direction and is coincident with where the right and left sloping surfaces meet and the plateau of the bottom protrusion defines a midpoint and a centerline that runs in a direction parallel with the Y direction through the midpoint, wherein the centerline of the top protrusion is offset from the centerline of the top protrusion in the X direction.

5. The latch lever bar of claim 1 wherein the latch lever bar comprises a body that includes a first end that includes the pivot connecting portion and a second end that is at the opposite end of the body and that defines an aperture, and the top protrusion and the bottom protrusion are disposed between the pivot connecting portion and the aperture along a direction parallel with the X direction.

6. A dipper door comprising:

a latching mechanism; and a tripping mechanism interface that is configured to initiate movement of the latching mechanism, wherein the latching mechanism includes a latch bar that includes a yoke and a latch lever bar that comprises:

an interface portion that includes a straight surface that is configured to contact the yoke of a latch bar; and a pivot connecting portion that is configured to pivotally connect the latch lever bar to the door, wherein the pivot connecting portion defines a pivot point that is collinear with the straight surface of the interface portion of the latch lever bar;

wherein the latch lever bar comprises a body that defines an X and a Y direction, and wherein the latch lever bar comprises a top protrusion that extends from the body a distance measured in the Y direction;

the body of the latch lever bar defines a bottommost edge adjacent the yoke interface portion along the X direction and a recess with an apex that extends from the bottommost edge along the X direction, the body further comprising a bottom protrusion that extends from the body a distance measured in the negative Y direction;

the bottom protrusion includes a plateau and the top protrusion includes a right sloping surface that is configured to be a stop surface.

7. The dipper door of claim 6 further comprising a rib that defines a slot that is configured to receive the latch lever bar and limit the movement of the latch lever bar.

8. The dipper door of claim 7 further comprising stop members placed into the slot.

9. The dipper door of claim 7 wherein the rib is an integrally cast component.

10. The latch lever bar of claim 6 wherein the interface portion is uninterrupted by any other geometrical feature other than the straight surface.

11. The latch lever bar of claim 6 wherein the latch lever bar comprises a body that includes a first end that includes a pivot connecting portion and a second end that is at the opposite end of the body and that defines an aperture, and the top protrusion and the bottom protrusion are disposed between the pivot connecting portion and the aperture along a direction parallel with the X direction.

* * * * *